US008763702B2

(12) United States Patent
Peter

(10) Patent No.: US 8,763,702 B2
(45) Date of Patent: Jul. 1, 2014

(54) HEAT DISSIPATER FOR ELECTRONIC COMPONENTS IN DOWNHOLE TOOLS AND METHODS FOR USING THE SAME

(75) Inventor: Andreas Peter, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 12/535,545

(22) Filed: Aug. 4, 2009

(65) Prior Publication Data

US 2010/0032161 A1 Feb. 11, 2010

Related U.S. Application Data

(60) Provisional application No. 61/086,334, filed on Aug. 5, 2008.

(51) Int. Cl.
*E21B 36/00* (2006.01)

(52) U.S. Cl.
USPC ..... 166/302; 166/57

(58) Field of Classification Search
USPC ..... 166/302, 57; 175/17
See application file for complete search history.

(56) References Cited

U.S. PATENT DOCUMENTS

| | | | | |
|---|---|---|---|---|
| 4,400,858 | A | 8/1983 | Goiffon et al. | |
| 4,547,833 | A * | 10/1985 | Sharp | 361/716 |
| 5,045,972 | A * | 9/1991 | Supan et al. | 361/706 |
| 5,554,897 | A | 9/1996 | Martin et al. | |
| 5,720,342 | A * | 2/1998 | Owens et al. | 166/57 |
| 5,881,825 | A | 3/1999 | Collee et al. | |
| 6,225,695 | B1 * | 5/2001 | Chia et al. | 257/712 |
| 6,311,621 | B1 | 11/2001 | Marshall et al. | |
| 6,341,498 | B1 | 1/2002 | DiFoggio | |
| 6,625,027 | B2 | 9/2003 | Rider et al. | |
| 6,877,352 | B1 | 4/2005 | Schlereth | |
| 6,919,504 | B2 * | 7/2005 | McCutcheon et al. | 174/16.3 |
| 7,017,662 | B2 * | 3/2006 | Schultz et al. | 166/254.2 |
| 7,124,596 | B2 | 10/2006 | DiFoggio et al. | |
| 7,246,940 | B2 | 7/2007 | Storm et al. | |
| 7,308,795 | B2 | 12/2007 | Hall | |
| 7,347,267 | B2 | 3/2008 | Morys et al. | |
| 7,806,173 | B2 | 10/2010 | Kaul et al. | |
| 8,020,621 | B2 * | 9/2011 | DiFoggio et al. | 166/302 |
| 2005/0097911 | A1 | 5/2005 | Revellat et al. | |

(Continued)

FOREIGN PATENT DOCUMENTS

JP 2000-303126 10/2000

OTHER PUBLICATIONS

"Air Data With and Without Fans".
"BIOTEMP—ABB Sensible Solution".

(Continued)

*Primary Examiner* — Giovanna Wright
(74) *Attorney, Agent, or Firm* — Mossman, Kumar & Tyler, PC

(57) ABSTRACT

A device for dissipating heat away from a heat sensitive component includes a heat dissipation member thermally coupled to a heat sensitive component. The heat dissipation member may be formed of a composite material. In aspects, the device may be include an enclosure coupled to a conveyance device; a heat sensitive component disposed in the enclosure; and a composite heat dissipation member thermally coupled to the heat sensitive component. The composite heat dissipation member may include a metal and a non-metal. The apparatus may also include an encapsulation substantially encapsulating the heat dissipation member and the heat sensitive component.

20 Claims, 3 Drawing Sheets

(56) References Cited

U.S. PATENT DOCUMENTS

| | | | | |
|---|---|---|---|---|
| 2006/0191682 | A1 | 8/2006 | Storm et al. | |
| 2007/0114021 | A1 | 5/2007 | Brown et al. | |
| 2008/0277162 | A1* | 11/2008 | DiFoggio | 175/17 |
| 2009/0032259 | A1 | 2/2009 | DiFoggio et al. | |
| 2010/0147523 | A1 | 6/2010 | DiFoggio | |

OTHER PUBLICATIONS

"Diffrences in Heat Build Up in Vacuum/Air/Helium".

K. Seiferlin et al., "The Effect of Soil Cementation on the Thermal Conductivity," Geophysical Research Abstracts, vol. 9, 02361, 2007.

C. Poulier et al., "Evolution of Thermophysical Characteristics inTin Oxide: From Pressed Powder Compact to Fired Porous Body," J. Am. Ceram. Soc. 91[3] 965-969 (2008).

Focus I Beam Side A.

"Thermal Conductivity vs. Coefficient of Expansion," http://www.aps.org/publicationsapsnews/200502/forefronts.cfm.

"Piezoelectric Fans to Cool Heat-Generating Downhole Electronics".

L. Sherman,"Plastics that Conduct Heat" http://www.ptonline.com/articles/200106fa1.html.

K. Watson, The Thermal Conductivity Measurements of Selected Silicate Powers in Vacuum From 150-350K.

"Thermal Conductivity of Air vs. Temperature".

P.W. May et al., "Thermal Conductivity of CVD Diamond Fibres and Diamond Fibre-reinforced Epoxy Composites," http://www.sciencedirect.com, Diamond & Related Materials 14 (2005) 598-603.

"Thermal Conductivity of Gases with Minimum Sensitivity and ISL Gas Groups".

"Vacuum 7 Watts".

"Water Heat Pipes Above 150 C," http://www.1act.com/htwhp.html.

* cited by examiner

HEAT DISSIPATER FOR ELECTRONIC COMPONENTS IN DOWNHOLE TOOLS AND METHODS FOR USING THE SAME

BACKGROUND OF THE DISCLOSURE

This application takes priority from U.S. Provisional Application Ser. No. 61/086,334 filed on Aug. 5, 2008, which is hereby incorporated by reference for all purposes.

BACKGROUND OF THE DISCLOSURE

1. Field of the Disclosure

The disclosure relates to protecting heat sensitive components used in downhole applications by dissipating heat away from such components.

2. Description of the Prior Art

Oil and gas are generally recovered from subterranean geological formations by means of oil wells. Typically, the well is drilled to and more often through an oil producing formation. This hole is commonly referred to as a wellbore or bore hole of the oil well and any point within the wellbore is generally referred to as being downhole. In recent times, the drilling systems used to form the wellbores have deployed more electronic components into the wellbore to increase drilling precision and efficiencies. These electronic components may be used in devices such as communication devices, Measurement While Drilling (MWD) logging tools, data processors, and other electronic equipment.

The present disclosure addresses the need to protect such electronic components from thermal energy loadings.

SUMMARY OF THE DISCLOSURE

In aspects, the present disclosure provides devices for dissipating heat generated by one or more heat sensitive components deployed in a downhole environment. In embodiments, the device may include a heat dissipation member thermally coupled to a heat sensitive component. In some arrangements, the heat dissipation member may be formed, at least partially, of a composite material that is both relatively light weight and has a relatively high thermal conductivity. The composite material may include a metal and diamond particles.

In aspects, one method provided by the present disclosure includes conveying a downhole tool into a wellbore using a conveyance device such as a coiled tubing or drill pipe. To thermally dissipate heat from heat sensitive components associated with the downhole tool, one or more composite heat dissipation members may be thermally coupled to the heat sensitive components. The heat sensitive components may be used in connection with downhole processing devices, sensors, transmitters, memory devices, communication devices, electronic devices, etc. During deployment downhole, the heat dissipation members draw heat from the heat sensitive components and radiate that heat from one or more surfaces.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The disclosure is best understood with reference to the accompanying figures in which like numerals refer to like elements, and in which.

DESCRIPTION OF THE DISCLOSURE

Figure 1:
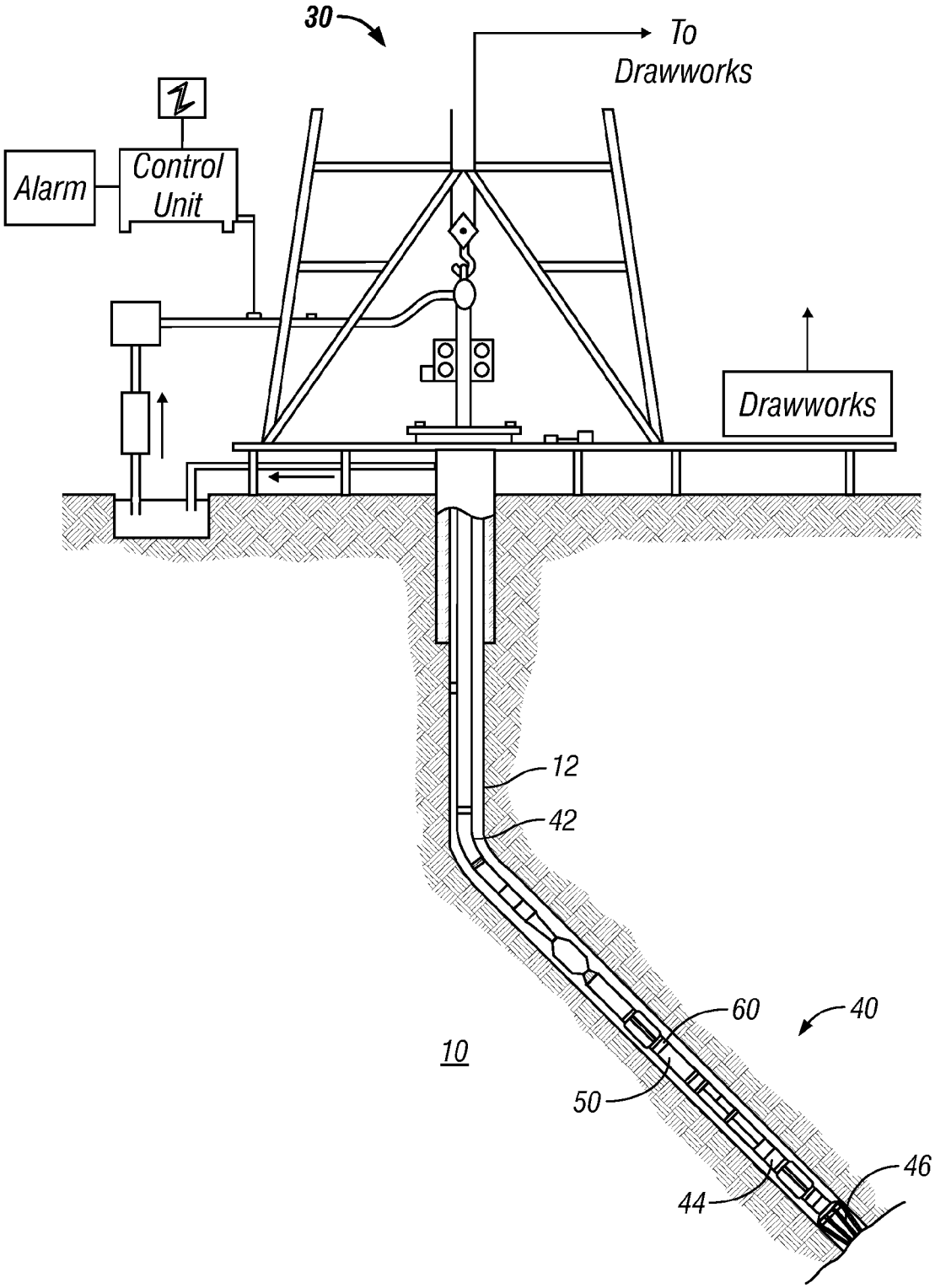
FIG. 1 schematically illustrates an MWD tool string deployed in a wellbore that may utilize embodiments of heat dissipating devices made in accordance with the present disclosure.

The present disclosure relates to devices and methods adapted to dissipate heat from heat sensitive components in a wellbore environment. The term "heat sensitive component" shall hereinafter be used to refer to any tool, electrical component, sensor, electronic instrument, structure, or material that degrades either in performance, structural integrity, operating efficiency, operating life, or reliability when exposed to a thermal loading outside of the operating norm for that component.

Aspects of the present disclosure may be utilized to provide a more robust thermal loading management system for downhole tools. As will be appreciated, the present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is schematically illustrated a drilling system utilizing a thermal management system according to aspects of the present disclosure. While a land system is shown, the teachings of the present disclosure may also be utilized in offshore or subsea applications. In FIG. 1, a laminated earth formation 10 is intersected by a well bore 12. A drilling system 30 having a bottom hole assembly (BHA) or drilling assembly 40 is conveyed via a tubing 42 into the wellbore 12 formed in the formation 10. The tubing 42 may be jointed drill pipe or coiled tubing, which may include embedded conductors for power and/or data for providing signal and/or power communication between the surface and downhole equipment. The BHA 40 may include a drilling motor 44 for rotating a drill bit 46. Other devices that may be present, but not shown, along the BHA 40 may include a steering assembly for steering the drill bit 46 in a selected direction, one or more BHA processors, one or more stabilizers, and other equipment known to those skilled in the art. The drill bit 46 may be rotated in any one of three modes: rotation by only the tubing 42, rotation by only the drilling motor 44, and rotation by a combined use of the tubing 42, and drilling motor 44. The BHA 40 also includes a logging tool 50, which may include a suite of tool modules, that obtain information relating to the geological, geophysical and/or petrophysical characteristics of the formation 10 being drilled. The subsurface components will be collectively referred to as a drill string 60.

The logging tool 50 may include formation evaluation tools adapted to measure one or more parameters of interest relating to the formation or the wellbore 12. It should be understood that the term formation evaluation tool encompasses measurement devices, sensors, and other like devices that, actively or passively, collect data about the various characteristics of the formation, directional sensors for providing information about the tool orientation and direction of movement, formation testing sensors for providing information about the characteristics of the reservoir fluid and for evaluating the reservoir conditions. The formation evaluation sensors may include resistivity sensors for determining the formation resistivity, dielectric constant and the presence or absence of hydrocarbons, acoustic sensors for determining the acoustic porosity of the formation and bed boundaries in the formation, nuclear sensors for determining the formation density, nuclear porosity and certain rock characteristics, nuclear magnetic resonance sensors for determining the porosity and other petrophysical characteristics of the formation. The direction and position sensors may include a combination of one or more accelerometers and one or more gyroscopes or magnetometers. The accelerometers may provide measurements along three axes. The formation testing sensors collect formation fluid samples and determine the properties of the formation fluid, which include physical properties and chemical properties. Pressure measurements of the formation provide information about the reservoir characteristics.

The BHA 40 as well as the logging tool 50 may include heat sensitive components. Such components include those that incorporate transistors, integrated circuits, resistors, capacitors, and inductors, as well as electronic components such as sensing elements, including accelerometers, magnetometers, photomultiplier tubes, and strain gages. The BHA 40 may also include communication devices, transmitters, repeaters, processors, power generation devices, or other devices that may incorporate heat sensitive components. The thermal management systems provided by the present disclosure, such as those shown in the Figures, may be utilized to protect these components from applied thermal loadings as well as heat generated by the electronic components themselves.

Figure 2:
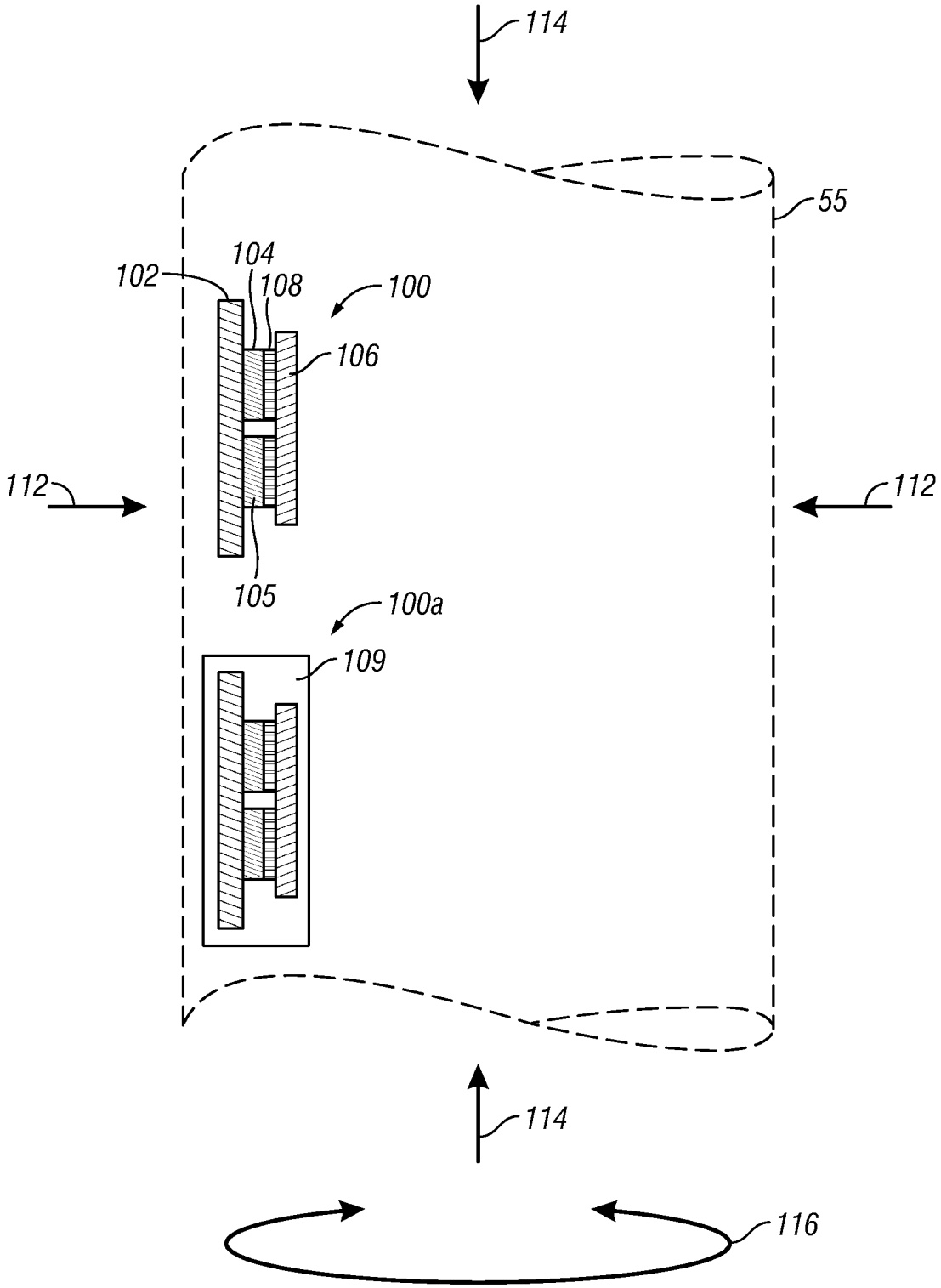
FIG. 2 isometrically illustrates in a sectional view one embodiment of heat sensitive components, thermally coupled to heat dissipating members made in accordance with the present disclosure.

Referring now to FIG. 2, there is shown in schematic form an electronic component 100 that may be utilized in one or more devices (e.g., the logging tool 50 or BHA 40 of FIG. 1) along the drill string 60. The electronic component 100 may be oriented in any manner. In one arrangement, the component 100 may include a printed circuit board 102, one or more integrated chips 104, 105 and a heat dissipation member 106. The electronic component 100 may be housed with a housing (not shown) that may be formed of a plastic or other suitable material. The heat dissipation member 106 may be thermally coupled to the chips 104, 105 with an affixing agent 108 such as a glue or epoxy. In certain embodiments, the affixing agent 108 may have thermal conductivity between about 0.60 W/m*k and about 1.20 W/m*k.

Referring still to FIG. 2, in one variant shown as component 100*a*, shell or encapsulation 109 may be utilized to enclose the electronic component 100. In some embodiments, the encapsulation may include a silicone rubber. In other embodiments, a suitable epoxy or other potting material may be utilized. The encapsulation 109 may be formulated or configured to function as a heat sink that absorbs heat generated by the electronic component 100.

The heat dissipation member 106 may configured to draw heat energy from the chips 104, 105. This heat energy may be then radiated from one or more surfaces of the dissipation member 106. The surfaces may be aligned to radiate the heat away from the chips 104, 105. In one embodiment, the heat dissipation member may be formed as a member having a relatively high thermal conductivity. Due to the relatively low thermal impedance, the heat generated by the chips 104, 105 readily "flows" into the heat dissipation member 106. The member may be formed as a platen member having a square or rectangular shape. However, other geometric shapes may also be suitable. The heat dissipation member may also be generally solid or include slots or other openings that increase the available surface area from which to radiate heat. As shown, a single heat dissipation member 106 may be thermally coupled to two or more chips. However, in certain embodiments, each chip may have a separate heat dissipation member 106. For the reason discussed below, in addition to having high thermal conductivity, the heat dissipation member 106 may be configured to be relatively lightweight, i.e., have relatively a low mass.

During drilling, the component 100 may be subjected to numerous types of motion that include, but are not limited to, vibrations. Such vibrations could include lateral vibrations shown with arrows 112, axial vibrations shown with arrows 114, and torsional vibrations shown with arrows 116. These vibrations, which may occur simultaneously, may stress the connections between the printed circuit board 102 and the integrated chips 104, 105. For instance, these vibrations may apply shear forces or bending moments on the solders (not shown) connecting the chips 104, 105 to the printed circuit board 102. The mass of the heat dissipation member 106 may increase these undesirable forces that are applied to the solders or other connection mechanisms associated with the chips 104, 105. Moreover, the use of composite heat dissipation members may enable electronic equipment to be positioned closer to the source of a vibration; e.g., the drill bit 46.

Thus, in embodiments, the heat dissipation member 106 may be formed of a material that is formulated to have a relatively low mass while also exhibiting a relatively high thermal conductivity. In some applications, the thermal conductivity may be at least 400 W/m*k. In embodiments, the material may be a composite material that includes a metal and a non-metal. In certain arrangements, the composite material may include an aluminum and diamond particles. One non-limiting material is available from PLANSEE Thermal Management Solutions, Inc., San Diego, Calif., USA. However, it should be understood that other materials may also be adequate. For example, a suitable material may have a density less than about nine grams per cubic centimeter. For some applications, the composition material has a density less than about four grams per cubic centimeter.

Referring now to FIGS. 1 and 2, during drilling operations, one or more of the components 100 may be utilized and operated along the drill string 60. As the chips 104, 105 generate heat energy, the heat dissipation members 106 draw that heat energy away from the chips 104, 105 and dissipate that energy over a relatively larger surface area. Thus, the heat dissipation member 106 may reduce the risk of localized "hot spots" on the components as well as reduce the overall temperature loading of the components 100. Further, as the drill string 60 moves through the wellbore 12 and during drilling, it should be appreciated that minimizing the mass of the heat dissipation member 106 reduces the mechanical loading on the chips 104, 105. Accordingly, the vibrations and other motions of the drill string 60 may have a reduced affect on the solder connections and other structures of the electronic component 100. Thus, the mechanical integrity and reliability of the components 100 may also be increased.

Figure 3:
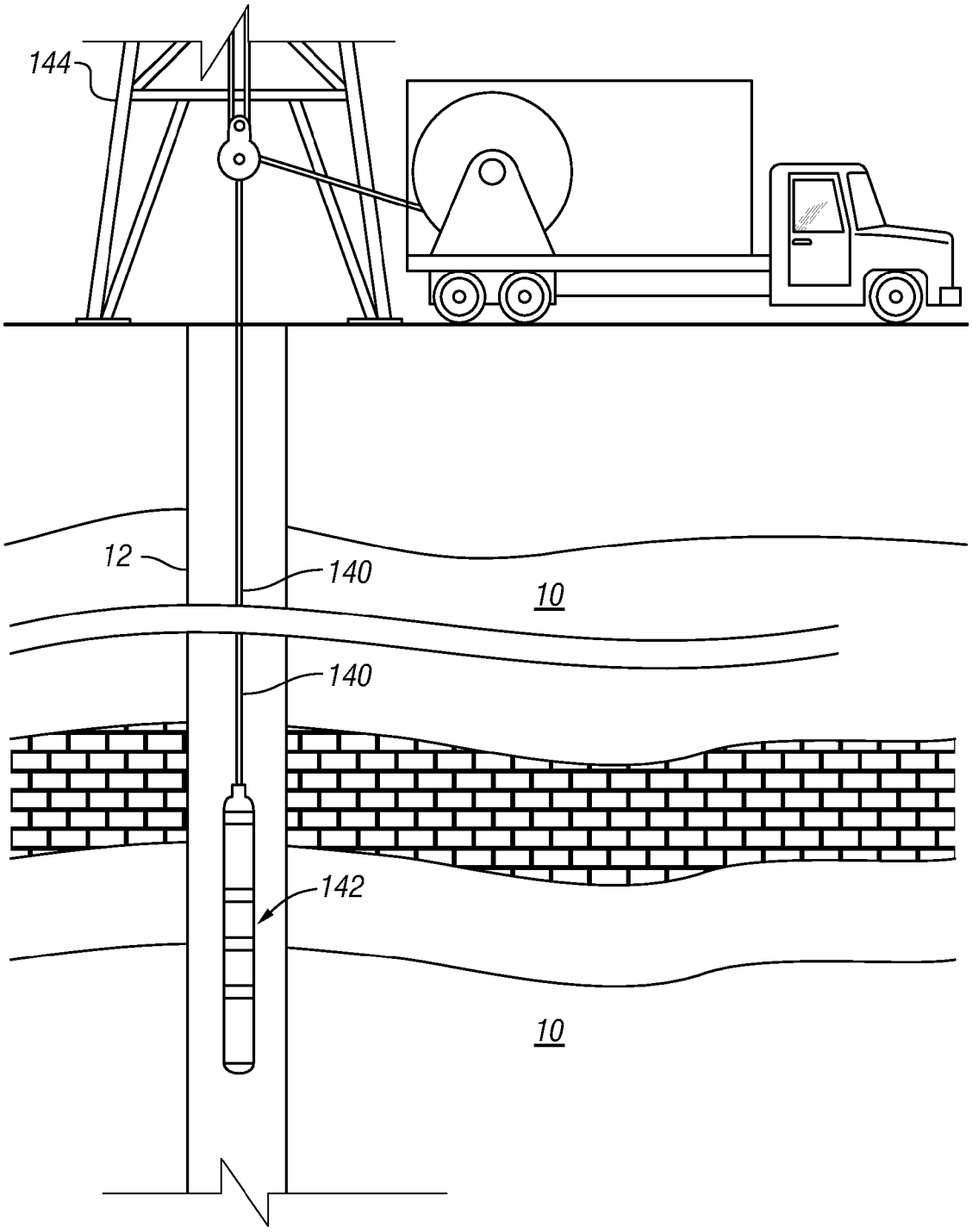
FIG. 3 schematically illustrates a Wireline tool string deployed in a wellbore that may utilize embodiments of heat dissipating devices made in accordance with the present disclosure.

While a drilling system has been illustrated, aspects of the present disclosure may also be utilized with other subsurface applications that utilize non-rigid carriers such as a wireline or slick line. Referring now to FIG. 3, there is shown wireline 140 conveying a logging tool 142 having sensors and electronics protected by one or more thermal management devices into the well bore 12. The wireline 140 is suspended in the wellbore 12 from a rig 144. The logging tool 142 may include formation evaluation tools adapted to measure one or more parameters of interest relating to the formation or the wellbore 12 such as those discussed previously, e.g., tools that collect data about the various characteristics of the formation, directional sensors for providing information about the tool orientation and direction of movement, formation testing sensors for providing information about the characteristics of the reservoir fluid and for evaluating the reservoir conditions. The heat sensitive components of the logging tool 142 may also incorporate heat dissipation members 106 in accordance with the present disclosure. In typical wireline investigation operations, the logging tool 142 may not be subject to the magnitude of vibrations and shock that are associated with drilling activities. Nevertheless, composite based heat dissipation members may be useful to ensure that the heat is effectively drawn away from electronic components in the logging tool 142 and a more uniform temperature regime is maintained in the logging tool 142.

Thus, in aspects, what has been described includes, in part, an apparatus for dissipating heat away from a heat sensitive component deployed in a downhole environment. The apparatus may be conveyed into a wellbore with a conveyance device and include an enclosure coupled to the conveyance device; a heat sensitive component disposed in the enclosure; and a heat dissipation member thermally coupled to the heat sensitive component. The heat dissipation member may be formed of a composite material. In embodiments, the composite material may include a metal and a non-metal. For instance, the composite material may include aluminum and diamond particles. In variants, the apparatus may include an encapsulation substantially encapsulating the heat dissipation member and the heat sensitive component. Also, an affixing agent may be used to connect the platen member to the heat sensitive component.

In aspects, what has been described also includes, in part, a method for dissipating heat away from a heat sensitive component deployed in a downhole environment. The method may include thermally coupling a heat dissipation member to a heat sensitive component, the heat dissipation member being formed of a composite material; and conveying the heat sensitive component into a wellbore. In one arrangement, the method may include logging the wellbore. The method may also include drilling the wellbore while logging the wellbore.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. An apparatus for use in a wellbore, comprising:

a conveyance device configured to be deployed in the wellbore;

a heat sensitive component coupled to the conveyance device, the heat sensitive component having electrical connections connecting the heat sensitive component to a board, the electrical connections being responsive to vibrations; and a heat dissipation member thermally coupled to the heat sensitive component, the heat dissipating member being affixed to the heat sensitive member such that a mass of the heat dissipating member causes an increase in forces applied to the connections due to the vibrations, the heat dissipation member being formed of a composite material and having a heat radiating surface configured and aligned to radiate heat conducted away from the heat sensitive component.

2. The apparatus of claim 1, wherein the composite material includes at least a metal and a non-metal, and wherein the forces increased by the mass of the heat dissipation member include at least a shear force and a bending moment and wherein the vibrations include at least an axial vibration, a lateral vibration, and a torsional vibration.

3. The apparatus of claim 1, wherein the composite material includes at least aluminum and diamond particles.

4. The apparatus of claim 1, further comprising an encapsulation at least partially encapsulating the heat dissipation member and the heat sensitive component, the encapsulation being configured to draw heat away from the heat sensitive component.

5. The apparatus of claim 1, further comprising an affixing agent connecting the heat dissipation member to the heat sensitive component, and wherein the heat sensitive component is configured to generate heat.

6. The apparatus of claim 1, wherein the composite material has a thermal conductivity of at least 400 W/m*k.

7. The apparatus of claim 1, wherein the composite material has a density less than about four grams per cubic centimeter.

8. The apparatus of claim 1, wherein the conveyance device is one of: (i) a drill string, and (ii) a wireline.

9. The apparatus of claim 1, wherein the heat sensitive component includes the board and at least one chip connected to the board, wherein the electrical connection is a soldered connection between the at least one chip and the board, and wherein the heat dissipating member is fixed to the at least one chip.

10. The apparatus of claim 1, wherein the heat sensitive component has heat radiating surfaces and wherein the heat radiating surface of the heat dissipation member has a larger surface area than the heat radiating surfaces of the heat sensitive component.

11. A method for operating a device in a wellbore, comprising:

forming a heat dissipation member of a composite material;

thermally coupling the heat dissipation member to a heat sensitive component, the heat sensitive component having electrical connections responsive to vibrations, and the heat dissipation member being affixed to the heat sensitive member such that the heat dissipating member causes an increase in forces applied to the connections due to the vibrations;

conveying the heat sensitive component into a wellbore;

radiating heat away from the heat sensitive component using a surface of the heat dissipation member.

12. The method of claim 11, wherein the composite material includes at least a metal and a non-metal, wherein the electrical connections are between the heat sensitive component and a printed circuit board, and wherein the heat dissipation member is affixed to the heat sensitive component.

13. The method of claim 11, wherein the composite material includes at least aluminum and diamond particles.

14. The method of claim 11, further comprising drawing heat away from the heat sensitive component using an encapsulation that at least partially encapsulates the heat dissipation member and the heat sensitive component.

15. The method of claim 11, further comprising connecting the heat dissipation member to the heat sensitive component with an affixing agent.

16. The method of claim 11, wherein the composite material has a thermal conductivity of at least 400 W/m*k.

17. The method of claim 11, wherein the composite material has a density less than about four grams per cubic centimeter.

18. The method of claim 11, further comprising at least one of: (i) logging the wellbore; and (ii) drilling the wellbore.

19. The method of claim 11, further comprising generating heat by energizing the heat sensitive component, affixing the heat dissipating member to the heat sensitive component.

20. The method of claim 11, wherein the heat sensitive component has heat radiating surfaces and wherein the heat radiating surface of the heat dissipation member has a larger surface area than the heat radiating surfaces of the heat sensitive component.

* * * * *